US012104313B2

(12) United States Patent
Kim et al.

(10) Patent No.: US 12,104,313 B2
(45) Date of Patent: Oct. 1, 2024

(54) LAUNDRY TREATMENT APPARATUS

(71) Applicant: LG Electronics Inc., Seoul (KR)

(72) Inventors: Jongryul Kim, Seoul (KR); Hyunsu Nam, Seoul (KR); Youngsoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 905 days.

(21) Appl. No.: 17/173,875

(22) Filed: Feb. 11, 2021

(65) Prior Publication Data

US 2021/0254267 A1 Aug. 19, 2021

(30) Foreign Application Priority Data

Feb. 13, 2020 (KR) ..... 10-2020-0017432

(51) Int. Cl.
*D06F 58/24* (2006.01)
*D06F 58/20* (2006.01)

(52) U.S. Cl.
CPC ..... *D06F 58/24* (2013.01); *D06F 58/206* (2013.01)

(58) Field of Classification Search
CPC ..... D06F 58/24; D06F 58/206; D06F 58/20; D06F 58/22; D06F 39/083; D06F 25/00; D06F 35/008; D06F 39/006; D06F 58/12; D06F 58/26; D06F 2103/36; D06F 2103/56; D06F 2105/28; D06F 2105/30
See application file for complete search history.

(56) References Cited

U.S. PATENT DOCUMENTS

2010/0192397 A1 8/2010 Kim et al.
2014/0165416 A1* 6/2014 Pillot ..... D06F 58/20 34/82
2018/0171537 A1* 6/2018 Lee ..... B08B 3/14

FOREIGN PATENT DOCUMENTS

CN 101050591 10/2007
CN 102011295 4/2011
CN 102292496 12/2011
CN 103547728 1/2014
CN 105316918 2/2016
(Continued)

OTHER PUBLICATIONS

Translation, EP-3431650-A1 (Year: 2019).*
(Continued)

*Primary Examiner* — Jessica Yuen
(74) *Attorney, Agent, or Firm* — Fish & Richardson P.C.

(57) ABSTRACT

A laundry treatment apparatus includes a cabinet defining an external appearance of the apparatus and a base, a drum rotatably provided in the cabinet, a driver provided in the base to rotate the drum, a duct fastened to the base to form a circulation passage communicating with the drum, a heat pump having a heat exchanger provided in the circulation passage to heat air, and a discharge unit to discharge water generated by the heat exchanger. The base includes a water collection chamber that is configured to collect the water generated by the heat exchanger and has discharge surfaces having different inclined angles, thereby guiding flow of condensate water, and a discharge hole that is located adjacent to the water collection chamber and configured to communicate with the water collection chamber such that water guided by the at least one discharge surface is discharged through the discharge unit.

25 Claims, 9 Drawing Sheets

(56) References Cited

FOREIGN PATENT DOCUMENTS

| | | | | |
|---|---|---|---|---|
| CN | 105544142 | | 5/2016 | |
| CN | 107109765 | | 8/2017 | |
| DE | 112013003575 | T5 | 4/2015 | |
| EP | 3431650 | A1 * | 1/2019 | ..... D06F 58/24 |
| EP | 3587661 | A1 * | 1/2020 | ..... D06F 58/02 |
| WO | WO2015065299 | | 5/2015 | |
| WO | WO2016095968 | | 6/2016 | |

OTHER PUBLICATIONS

Extended European Search Report in European Appln. No. 21156751.6, dated Jul. 12, 2021, 34 pages.
Office Action in Chinese Appln. No. 202110190162.6, dated Nov. 15, 2022, 17 pages (with English translation).

* cited by examiner

A-A'

E-E'

LAUNDRY TREATMENT APPARATUS

CROSS-REFERENCE TO RELATED APPLICATIONS

This application claims the benefit of Korean Patent Application No. 10-2020-0017432, filed on Feb. 13, 2020, which is hereby incorporated by reference as if fully set forth herein.

TECHNICAL FIELD

The present disclosure relates to a laundry treatment apparatus, and more particularly to a laundry treatment apparatus including a base through which a discharge structure of the laundry treatment apparatus can be improved.

BACKGROUND

Generally, a laundry treatment apparatus may refer to an apparatus for washing laundry, an apparatus for drying wet or washed laundry, and/or an apparatus for performing washing and drying of laundry. Here, the laundry treatment apparatus may perform only a washing or drying function of laundry, or may perform both washing and drying functions of laundry.

A representative example from among conventional laundry treatment apparatuses capable of drying laundry may include a drum forming a space in which laundry is stored, a duct forming a passage through which air discharged from the drum is re-supplied to the drum, a first heat exchanger for cooling air flowing into the duct to dehumidify the air, a second heat exchanger for heating the air having penetrated the first heat exchanger, and a fan for moving the air having penetrated the second heat-exchanger to the drum.

The above-mentioned conventional laundry treatment apparatus is designed in a manner that air discharged from the drum is dehumidified and heated through the above heat exchangers so that the heated air is re-supplied to the drum, resulting in occurrence of problems due to foreign materials such as lint or contaminants remaining in the heat exchangers.

In order to address the above-mentioned issues, a representative example from among the conventional laundry treatment apparatuses has been disclosed in Korean Patent Laid-Open Publication No. 10-2011-0125570, which collects condensate water generated in a first heat-exchanger, and sprays the collected condensate water onto the heat-exchanger, so that foreign materials such as contaminants or lint remaining in the heat-exchanger can be separated and removed.

However, whereas a conventional laundry treatment apparatus provided with a washable filter has advantages in that the heat exchanger can be washed to prevent degradation in drying performance of laundry, the conventional laundry treatment apparatus has disadvantages in that foreign materials such as lint or contaminants, which are washed and separated from the heat exchanger, may remain in a discharge passage through which condensate water is discharged, resulting in unpleasant odor caused by the foreign materials that remain in the discharge passage for a long period of time. As a result, the conventional laundry treatment apparatus may be undesirable in terms of personal hygiene.

In addition, although the conventional laundry treatment apparatus is designed to induce movement of foreign materials such as lint by supplying at least a predetermined amount of water to the drum in a manner that the foreign materials washed by the heat exchanger can be discharged outside together with the condensate water cleaning the heat exchanger, there may occur a dead zone through which wash water does not pass according to the structural shape of a discharge passage and the flow direction of wash water. In addition, it is impossible for foreign materials remaining in the dead zone to be discharged outside together with wash water even when the sufficient amount of wash water is supplied to the drum of the conventional laundry treatment apparatus.

SUMMARY

Accordingly, the present disclosure is directed to a laundry treatment apparatus that substantially obviates one or more problems due to limitations and disadvantages of the related art.

An object of the present disclosure is to provide a laundry treatment apparatus for allowing foreign materials such as lint separated from a heat exchanger to be smoothly discharged outside together with wash water in a process of washing the heat exchanger.

Another object of the present disclosure is to provide a laundry treatment apparatus for reducing a dead zone through which wash water does not pass such that wash water having washed the heat exchanger can be smoothly discharged outside.

Another object of the present disclosure is to provide a laundry treatment apparatus for allowing condensate water generated by a heat exchanger to be smoothly discharged outside.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus may include a tub to store water, a drum provided in the tub to accommodate laundry, a drive unit coupled to the tub to rotate the drum, and a controller to detect vibration of the drum.

In accordance with one aspect of the present disclosure, a laundry treatment apparatus includes a cabinet forming an external appearance of the apparatus and configured to have a base, a drum rotatably provided in the cabinet, a driver provided in the base to rotate the drum, a duct fastened to the base to form a circulation passage communicating with the drum, a heat pump having a heat exchanger provided in the circulation passage to heat air, and a discharge unit to discharge water generated by the heat exchanger. The base includes a water collection chamber configured to collect the water generated by the heat exchanger, and formed to have at least one discharge surface having different inclined angles, thereby guiding flow of condensate water, and a discharge hole located adjacent to the water collection chamber, and formed to communicate with the water collection chamber in a manner that water guided by the at least one discharge surface is discharged through the discharge unit.

The laundry treatment apparatus may further include a first discharge surface configured to form a discharge direction inclined toward the discharge hole, and a second discharge surface located below the first discharge surface, and formed inclined toward the discharge hole by an inclined angle different from that of the first discharge surface.

The first discharge surface may include a first angle inclined downward toward the second discharge surface, and a second angle inclined toward the discharge hole.

The first angle may be inclined downward toward the second discharge surface by an angle of about 2° to 4°.

The second angle may be inclined downward toward the discharge hole by an angle of about 0.5° to 2.5°.

The second discharge surface may be formed horizontal to a direction from the first discharge surface to the second discharge surface, and may be formed inclined toward the discharge hole by a third angle.

The third angle may be inclined downward by an angle of 0.5° to 2.5°.

The discharge hole may be formed at one side of a discharge direction of the water collection chamber. The discharge surface may further include a third discharge surface in a direction opposite to the discharge hole.

The third discharge surface may be formed to protrude from the second discharge surface as a right-angled triangle shape in a manner that an edge portion of the water collection chamber arranged to face the discharge hole is at a right angle.

The third discharge surface may further include a fourth angle inclined downward toward the first discharge surface.

The fourth angle may be inclined downward toward the first discharge surface by an angle of about 1° to 3°.

The third discharge surface may further include a fifth angle inclined downward toward the discharge hole.

The fifth angle may be inclined downward toward the discharge hole by an angle of about 1° or less.

The third discharge surface may be curved in a concave shape in which one side arranged to face a right-angled edge of the water collection unit is inclined toward the discharge hole.

The second discharge surface arranged to face the third discharge surface may further include a stepped portion configured to support the heat exchanger.

The stepped portion may be formed to correspond to a height of the third discharge surface.

The stepped portion and an upper portion of the third discharge surface may be provided with a plurality of support protrusions on which a lower portion of the heat exchanger is seated.

The stepped portion and an edge portion of the second discharge surface may be formed to have a radius in a manner that the stepped portion and the edge portion of the second discharge surface are curved in a concave shape.

An edge portion where the second discharge surface and the third discharge surface meet each other may be formed to have a radius in a manner that the edge portion is curved in a concave shape.

The circulation passage may further include a washing unit configured to wash the heat exchanger by spraying water into the heat exchanger.

The discharge unit may include a pump configured to pump water introduced into the discharge unit, wherein the pump supplies the water to the washing unit.

The discharge unit may include a pump discharge surface located lower than the discharge surface.

The water collection chamber may include an outer wall forming a water collection space, and an edge portion where the outer wall and the discharge surface meet each other may be formed to have a radius in a manner that the edge portion is curved in a concave shape.

It is to be understood that both the foregoing general description and the following detailed description of the present disclosure are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

In the following description of the present disclosure, names of constituent components to be defined are determined in consideration of their functions. Accordingly, it should be understood that the following description should not be construed as limiting technical components of the present disclosure. In addition, names of the constituent elements defined in the present disclosure can also be called other names by those skilled in the art.

A laundry treatment apparatus according to embodiments of the present disclosure will hereinafter be described with reference to the attached drawings.

Figure 1:
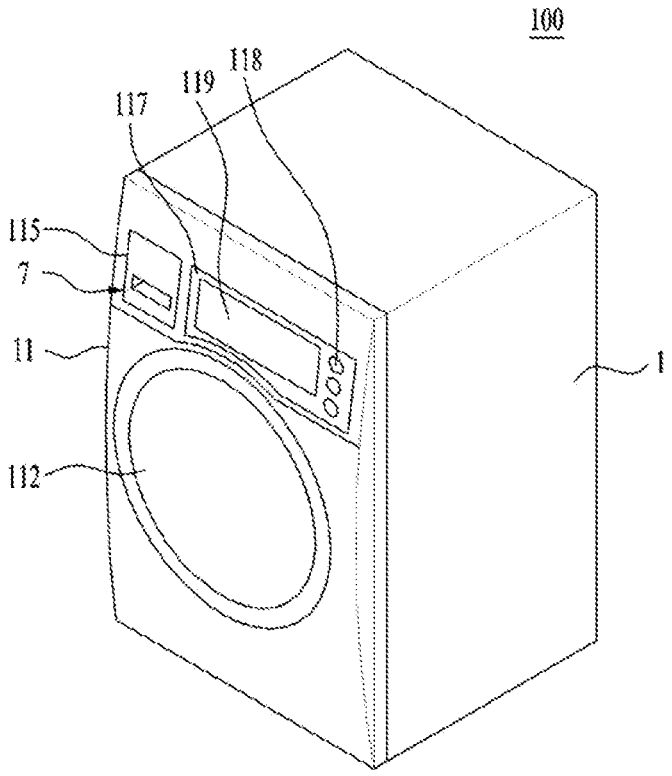
FIG. 1 is a perspective view illustrating a laundry treatment apparatus according to an embodiment of the present disclosure.
Figure 2:
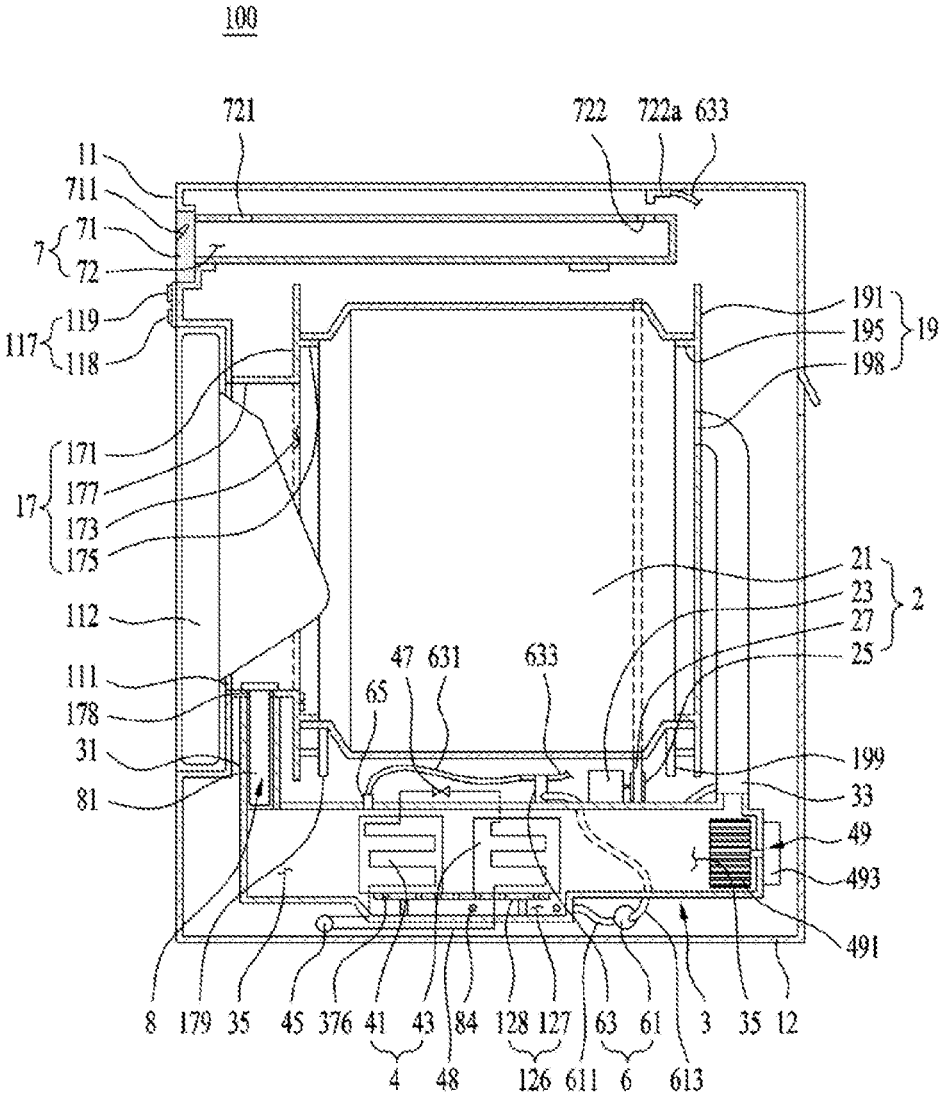
FIG. 2 is a cross-sectional view illustrating an internal structure of the laundry treatment apparatus according to an embodiment of the present disclosure.

FIG. 1 is a perspective view illustrating a laundry treatment apparatus 100 according to the present disclosure. FIG. 2 is a cross-sectional view illustrating an internal structure of the laundry treatment apparatus 100 according to the present disclosure.

Referring to FIGS. 1 and 2, the laundry treatment apparatus 100 may include a cabinet 1, a drum 2 rotatably provided in the cabinet 1 to provide a space in which laundry is stored, a duct 3 for forming a passage through which air discharged from the drum 2 is re-supplied to the drum 2, and a heat exchanger 4 for dehumidifying and heating the air introduced into the duct 3 and re-supplying the heated air to the drum 2.

The cabinet 1 may include a front panel 11 forming a front surface of the laundry treatment apparatus. The front panel 11 may include an inlet 111 communicating with the drum 2, and a door 112 rotatably coupled to the cabinet 1 to open and close the inlet 111.

The front panel 11 may include a control panel 117. The control panel 117 may include an input unit 118 for receiving a control command from a user, and a display unit 119 for displaying information such as a user-selectable control command or the like.

The input unit 118 may include a power-supply request unit for requesting the laundry treatment apparatus 100 to perform power supply, a course input unit for enabling the user to select a desired course from among a plurality of courses, and an execution request unit for requesting initiation of the user-selected course.

The display unit 119 may include at least one of a display panel capable of displaying text and figures thereon and a speaker capable of outputting a voice signal and sound.

A base 12 may be provided below the cabinet 1 so as to support constituent elements (e.g., the drum 2, the duct 3, the heat exchanger 4, etc.) of the laundry treatment apparatus. Thus, the constituent elements are installed on the base 12. The base 12 will hereinafter be described in detail with reference to the attached drawings.

When the drum 2 is formed in a cylindrical drum body 21 in which a front end and a rear end are opened, the cabinet 1 may include a first support 17 for rotatably supporting the front surface of the drum 2 and a second support 19 for rotatably supporting the rear surface of the drum 2.

The first support 17 may include a first fixed body 171 fixed into the cabinet 1, a drum inlet 173 formed to penetrate the first fixed body in a manner that the inlet 111 communicates with the inside of the drum body 21, and a first support body 175 provided in the first fixed body 171 in a manner that the first support body 175 is inserted into the front surface (referred to as a first open surface) of the drum body 21.

The first fixed body 171 may be formed in any shape in which the drum inlet 173 and the first support body 175 can be positioned. The first support body 175 may be formed in a pipe shape protruding from the first fixed body toward the drum body 21.

On the other hand, a diameter of the first support body 175 may be larger than a diameter of the drum inlet 173 and may be smaller than a diameter of the front surface of the drum body 21. In this case, the drum inlet 193 may be located in a space formed by the first support body 175.

The first support 17 may connect the inlet 111 to the drum inlet 173, and may further include a connection body 177. The connection body 177 may be formed in a pipe shape extending from the drum inlet 173 toward the inlet 111.

In this case, the connection body 177 may be provided with an air outlet 178 communicating with the duct 3. The air duct 178 may be a passage for allowing the air in the drum body 21 to flow into the duct 3, and may be provided with through-holes formed to pass through the connection body 177.

The second support 19 may include a second fixed body 191 fixed into the cabinet 1, and a second support body provided in the second fixed body 191 and inserted into the rear surface (referred to as a second open surface) of the drum body 21.

In addition, the second support 19 may include an air inlet 198 formed to pass through the second fixed body 191 so that the inside of the drum body 21 can communicate with the inside of the cabinet 1. In this case, the duct 3 may be provided to connect the air outlet 178 of the first support 17 to the air inlet 198 of the second support 19.

The drum body 21 may be formed in a hollow cylindrical shape, and may rotate by various types of drivers. In one embodiment of the present disclosure, the driver includes a motor 23 fixed into the cabinet 1, a pulley 25 configured to rotate by the motor 23, and a belt 27 for connecting a circumferential surface of the pulley 25 to a circumferential surface of the drum body 21, and a detailed description of the driver will hereinafter be given.

Meanwhile, the first support 17 may include a first roller for rotatably supporting the circumferential surface of the drum body 21, and the second support 19 may include a second roller for rotatably supporting the circumferential surface of the drum body 21.

The duct 3 may include an exhaust duct 31 connected to the air outlet 178, a supply duct connected to the air inlet 198, and a connection duct for connecting the exhaust duct 31 to the supply duct 33.

The heat exchanger 4 may be implemented as various devices capable of sequentially performing dehumidification and heating of air introduced into the duct 3. For convenience of description, the embodiment of the present disclosure will hereinafter be described with reference to an exemplary case in which the heat exchanger 4 is implemented as a heat pump.

The heat exchanger 4 may include a fan 49 for allowing air to flow along the duct 3, a first heat exchanger (i.e., a heat absorption unit) 41 for dehumidifying the air introduced into the duct 3, and a second heat exchanger (i.e., a heating unit) 43 provided in the duct 3 so as to heat the air having penetrated the first heat exchanger 41.

The fan 49 may include an impeller 491 provided in the duct 3 and an impeller 493 formed to rotate the impeller 491. The impeller 491 may be provided anywhere among the exhaust duct 31, the connection duct 35, and the supply duct 33. For convenience of description, the embodiment of the present disclosure will hereinafter be described with reference to an exemplary case (i.e., the case where the impeller 491 is located behind the heating unit) in which the supply duct 33 is provided with the impeller 491.

The heat absorption unit 41 may be formed of a plurality of metal plates arranged either in a width direction (X-axis direction) of the connection duct 35 or in a height direction (Z-axis direction) of the connection duct 35. The heating unit 43 may be formed of a plurality of metal plates arranged either in the width direction of the connection duct 35 or in the height direction of the connection duct 35.

In this case, the heat absorption unit 41 and the heating unit 43 may be sequentially arranged in the direction from the exhaust duct 31 to the supply duct 33 within the connection duct 35, so that the heat absorption unit 41 and the heating unit 43 may be connected to each other through a refrigerant pipe 48 forming a circulation passage of the refrigerant.

The refrigerant may move along the refrigerant pipe 48 by the compressor 45 located outside the duct 3. The refrigerant pipe 48 may include a pressure regulator 47 for adjusting a pressure of the refrigerant having penetrated the heating unit 43.

The heat absorption unit 41 may transmit heat of air introduced into the exhaust duct 31 to the refrigerant, so that the air is cooled and the refrigerant is evaporated. The heating unit 43 may transmit heat of the refrigerant having penetrated the compressor 45 to the air, so that the air is heated and the refrigerant is condensed. In this case, moisture contained in the air may be collected at the bottom surface of the connection duct 35 along the surface of the heat absorption unit 41 when passing through the heat absorption unit 41.

In order to collect water removed from the air having penetrated the heat absorption unit 41, the laundry treatment apparatus 100 may include a water collection unit 126 for storing collected water therein. In this case, the water collection unit 126 may be formed at one side of the base 12 to be described later. The water collection unit 126 may form a flow passage of air by coupling to the connection duct 35.

The water collection unit 126 of the base 12 may include a water collection chamber 127 that is fixed to a bottom surface of the connection duct 35 to communicate with the inside of the connection duct 35. In order for the heat absorption unit 41 and the heating unit 43 not to contact water (i.e., condensate water) stored in the water collection chamber 127, a heat exchanger support 128 may be additionally provided in the water collection chamber 127. The heat exchanger support 128 may maintain a gap among the heat absorption unit 41, the heating unit 43, and the bottom surface of the water collection chamber 127.

A plurality of support plate through-holes (not shown) may be formed to correspond to the position of the heat absorption unit 41 in the heat exchanger support 128 supporting both the heat absorption unit 41 and the heating unit 43. The support plate through-holes may guide water generated by the heat absorption unit 41 and/or water having washed the heat absorption unit 41 to the water collection chamber 127.

The laundry treatment apparatus 100 may further include a filter unit 8 to perform filtering of air, such that a minimum amount of foreign materials (such as lint or contaminants) discharged from the drum body 21 can be stacked on the heat absorption unit 41 and the heating unit 43 through the filter unit 8. The filter unit 8 may be used as a means for filtering the air introduced into the exhaust duct 31 from the drum body 21.

The filtering unit 8 may include a frame 81 detachably coupled to the exhaust duct 31 through the air outlet 178, and a filter (not shown) for filtering out lint contained in the air introduced into the outlet 178.

On the other hand, the laundry treatment apparatus 100 according to the present disclosure may further include a washing unit 6 to wash the heat absorption unit 41 using water stored in the water collection chamber 127, and a discharge unit 7 for discharging the water stored in the water collection chamber 127 to the outside of the water collection chamber 127.

The washing unit 6 may be provided as a means for washing the heat absorption unit 41 by spraying the water stored in the water collection chamber 127 to the heat absorption unit 41. The washing unit 6 may include a spray unit 65 provided in the duct 3 to supply the water to the heat absorption unit 41, and a pump 61 for moving the water stored in the water collection chamber 127 to the spray unit 65.

The pump 61 may enable water discharged from the water collection chamber 127 to flow into the spray unit 65 through a second connection pipe 613. The pump 61 and the water collection chamber 127 may be located adjacent to each other in a manner that the water stored in the water collection chamber 127 can move, or may be coupled to each other through a separate first connection pipe 611.

On the other hand, when the laundry treatment apparatus 100 is configured to allow water stored in the water collection chamber 127 to flow into the spray unit 65 and the discharge unit 7 using only one pump 61, the laundry treatment apparatus 100 may further include a passage switching unit 63.

In this case, the passage switching unit 63 may be connected to the pump 61 through the second connection pipe 613, the spray unit 65 may be connected to the passage switching unit 63 through a spray supply pipe 631, and the discharge unit 7 may be connected to the passage switching unit 63 through a discharge supply pipe 633.

The passage switching unit 63 may be provided with a valve (not shown) that is controlled to open or close the spray supply pipe 631 and the discharge supply pipe 63. Accordingly, the laundry treatment apparatus 100 may control the valve provided in the passage switching unit 53, such that water stored in the water collection chamber 127 may be provided to the spray unit 65 or the discharge unit 7.

The discharge unit 7 may include a storage body 72 that is detachably coupled to the cabinet 1 to provide a space in which water is stored, and an inlet 722 that is formed to penetrate the storage body 72 to enable water discharged from the discharge supply pipe 633 to flow into the storage body 72.

The storage body 72 may be formed in a drawer-type tank drawn out from the cabinet 1. In this case, it is necessary for the front panel 11 of the cabinet to include a hole mounted to the discharge unit (hereinafter referred to as a discharge-mounted hole) in which the storage body 72 is inserted. The panel 71 is fixed to the front surface of the storage body 72, and the panel 71 is detachably coupled to the drain mounting hole to form a portion of the front panel 11.

The panel 71 may further include a groove 711 into which a user's hand is inserted. In this case, the panel 71 may also serve as a handle that is capable of withdrawing the storage body 72 from the cabinet or inserting the storage body 72 into the cabinet.

The inlet 722 may be configured to receive water discharged from a nozzle **722*a* fixed to the cabinet 1. The nozzle 722*a* may be fixed to the front panel 13 of the cabinet such that the nozzle 722*a* is positioned above the inlet 722 when the storage body 72 is inserted into the cabinet 1. In this case, the discharge supply pipe 633 may be configured to interconnect the nozzle 722*a* and the passage switching unit 63**.

The discharge unit 7 having the above-mentioned structure may discard water stored in the storage body by action of the user who draws the storage body 72 from the cabinet 1 and controls the storage body 72 to be turned over or tilted in the direction of the inlet 722.

In this case, the laundry treatment apparatus may further include a communication hole 721 formed to penetrate the top surface of the storage body 72 in a manner that water stored in the storage body 72 can be easily discharged through the inlet 722.

Meanwhile, the laundry treatment apparatus 100 may further include a water-collection-unit water-level sensor (not shown) configured to measure a water level of the water collection chamber 127. The water-collection-unit water-level sensor may recognize a specific time at which water stored in the water collection chamber 127 is scheduled to flow into the storage body 72, thereby preventing the water stored in the water collection chamber 127 from flowing back into the connection duct 35.

The laundry treatment apparatus 100 may further include a dryness sensor (not shown) for sensing the degree of dryness of laundry. The dryness sensor may be implemented as at least one of an electrode sensor (not shown) and a humidity sensor (not shown). The electrode sensor may be in contact with laundry to measure the amount of moisture contained in the laundry. The humidity sensor may measure the degree of humidity contained in the air flowing from the drum 2 to the duct 3.

In addition, the laundry treatment apparatus 100 may further include a temperature sensor (not shown) for measuring a temperature of the air introduced into the duct 3.

On the other hand, the drum 2, the duct 3, the heat exchanger 4, the washing unit, and the discharge unit 7 may be supported and installed on the base 12 located at a lower portion of the cabinet 1. The base 12 may be configured in a manner that condensate water generated by the heat exchanger 4 and the wash water having washed the heat absorption unit 41 in the washing unit 6 are collected in the water collection chamber 127 of the water collection unit 126 so that the collected water can be supplied to the spray unit 65 or the discharge unit 7 by the pump 61.

The base 12 of the laundry treatment apparatus 100 according to the present disclosure will hereinafter be described with reference to the attached drawings.

Figure 3:
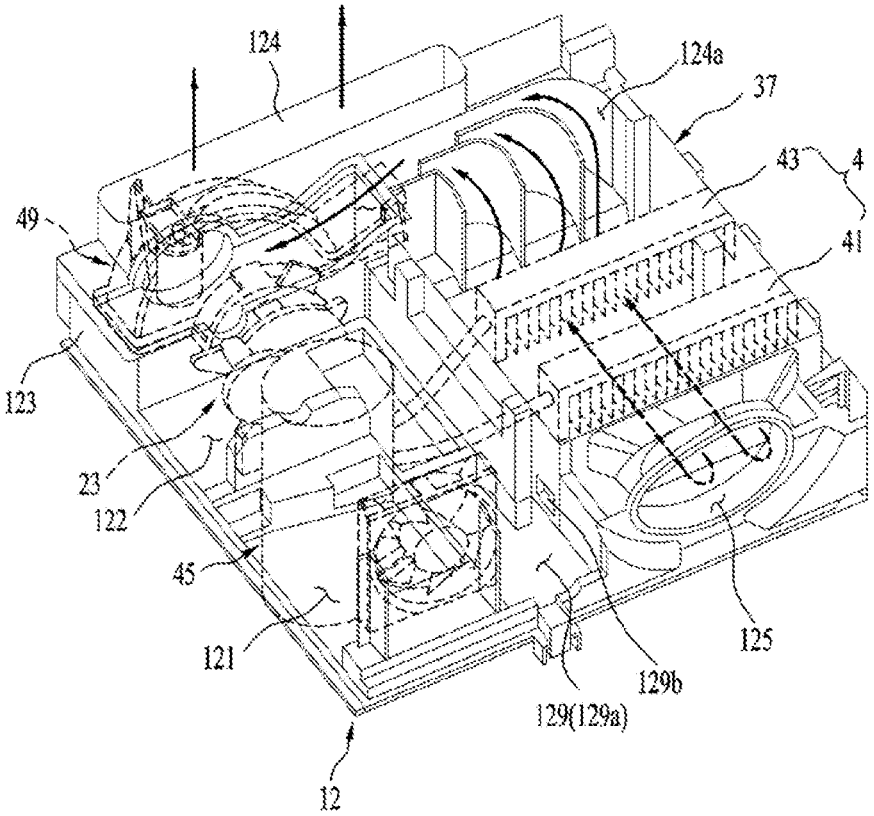
FIG. 3 is a perspective view illustrating a connection state of a base installed in the laundry treatment apparatus according to an embodiment of the present disclosure.
Figure 4:
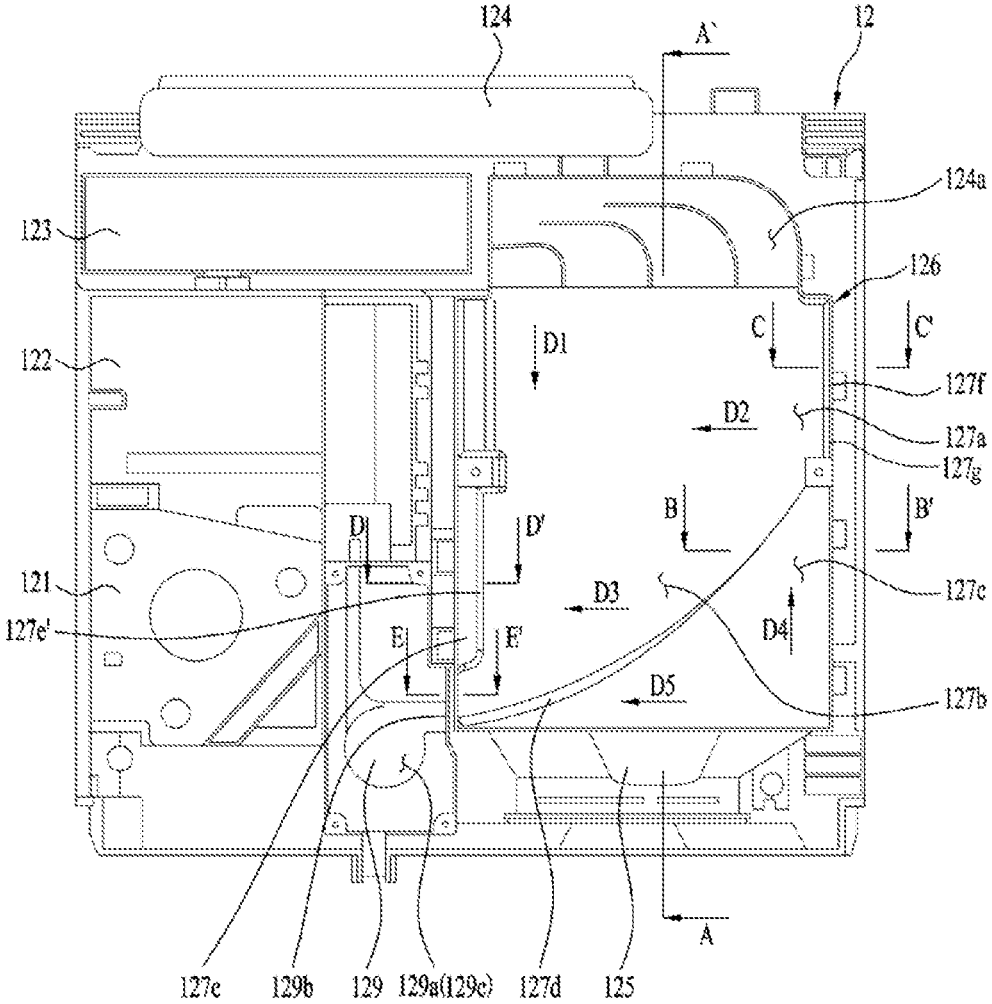
FIG. 4 is a plan view illustrating the base of the laundry treatment apparatus according to an embodiment of the present disclosure.

FIG. 3 is a perspective view illustrating a connection state of the base 12 installed in the laundry treatment apparatus 100 according to an embodiment of the present disclosure. FIG. 4 is a plan view illustrating the base 12 of the laundry treatment apparatus 100 according to an embodiment of the present disclosure.

Referring to FIGS. 3 and 4, the base 12 of the laundry treatment apparatus 100 may include a compressor mounting unit 121 in which the compressor 45 of the heat exchanger 4 is installed, a fan mounting unit 123 to which the fan of the heat exchanger 4 is mounted, a supply-duct connection unit 124 to which the supply duct 33 is connected, an exhaust-duct connection unit 125 to which the discharge duct 31 is connected, the water collection unit 126 in which water (condensate water) generated by the heat absorption unit 41 and water (wash water) having washed the heat absorption unit 41 are collected, and a pump mounting unit 129 in which the pump 61 for discharging water collected by the water collection unit 126 is installed. Here, the water collection unit 126 is coupled to the connection duct 35, and the heat absorption unit 41 and the heating unit 43 are provided in the water collection unit 126.

The compressor mounting unit 121, the motor mounting unit 122, the fan mounting unit 123, the water collection unit 126, and the pump mounting unit 129 formed in the base 12 can be arranged in various ways according to connection states of constituent elements and passage structures of the laundry treatment apparatus.

The water collection unit 126 may be coupled to the connection duct 35, and may be formed in a box shape in which the front end and the rear end are opened to form a passage. In the water collection unit 126, one side connected to both the water collection unit 126 and the connection duct 35 may be provided with the heat absorption unit 41 and the heating unit 43.

Meanwhile, the water collection unit 126 may be provided with the heat absorption unit 41 and the heating unit 43 of the heat exchanger 41. An exhaust-duct connection unit 125 coupled to the exhaust duct 31 may be located at the front end of the water collection unit 126, and a supply-duct connection unit 124 may be located at the rear end of the water collection unit 126. In addition, a switching passage 124*a* through which the direction of the air having penetrated the heat absorption unit 41 and the heating unit 43 of the water collection unit can switch to the supply duct 33, may be disposed between the water collection unit 126 and the supply duct 33.

A pump mounting unit 129 may be disposed at one side of the water collection unit 126. The pump 61 installed in the pump mounting unit 129 may be used to discharge water (including condensate water and wash water) collected by the water collection unit 126, and it is desirable that the pump 61 be formed at one side of the water collection unit 126.

A discharge hole 129*c* for guiding water collected in the water collection unit 128 to the pump mounting unit 129 may be disposed between the water collection unit 126 and the pump mounting unit 129. The pump mounting unit 129 may be provided with a pump discharge surface 129*b* that temporarily stores water discharged through the discharge hole 129*c* therein. In this case, the discharge surface 129*b* may be located lower than each of discharge surfaces 127*a*, 127*b*, and 127*c* of the water collection chamber 127 to be described later.

Therefore, water collected by the water collection unit 126 may flow into the pump mounting unit 129 through the discharge hole 129*c*, and the water introduced into the pump mounting unit 129 may be supplied to the washing unit 6 or the discharge unit 7.

On the other hand, the water collection chamber 127 may include a plurality of discharge surfaces 127*a*, 127*b*, and 127*c* inclined to allow not only water generated by the heat absorption unit 41 provided on the passage formed by the water collection chamber 127 and the connection duct 35, but also water sprayed from the washing unit 6 to wash the heat absorption unit 41, to flow into the discharge hole 129*c*.

In this case, the water collection chamber 127 may be formed in a rectangular shape according to the shapes of the heat absorption unit 41 and the heating unit 43 that are installed in the water collection chamber 127. Basically, the water collection chamber 127 may be formed to be inclined downward toward the discharge hole 129*c*. The discharge hole 129*c* formed to communicate with the water collection chamber 127 may be formed to communicate with one side of the water collection chamber 127.

Therefore, water collected in the water collection chamber 127 may form a passage while moving toward the discharge hole 129*c*. In a passage along which water moves along the bottom surface of the water collection chamber 127, the water may slowly move or may stop movement in one side opposite to the discharge hole 129*c*.

In other words, if water moves slowly or stops movement at the bottom surface of the water collection chamber 127, foreign materials such as lint to be introduced into the water collection chamber 127 together with wash water having washed the heat absorption unit 41 may remain on the bottom surface of the water collection chamber 127 without moving with the water. If such foreign materials remain on the bottom surface of the water collection chamber 127 for a long period of time, unpleasant odor may occur.

To this end, as shown in FIG. 4, the water collection chamber 127 may include at least two discharge surfaces formed at different heights in a manner that water introduced into the water collection chamber 127 can be smoothly discharged to the discharge hole 129*c* formed at one side of the front part of the water collection chamber 127.

In this case, at least one discharge surface may be formed in a curved shape in a direction opposite to the discharge hole 129*c* formed at one side of the front part of the water collection chamber 127.

The water collection chamber 127 according to the present disclosure will hereinafter be described with reference to the attached drawings.

In the following description of the water collection chamber 127 of the laundry treatment apparatus 100, a lower side of a vertical direction of the base 12 shown in FIG. 4 will hereinafter be defined as a front side, and an upper side of the vertical direction of the base 12 will hereinafter be defined as a rear side.

As shown in FIG. 4, the water collection chamber 127 may be disposed between the switching passage 124*a* and the exhaust-duct connection unit 125 at a predetermined portion of the base 12. The pump mounting unit 129 may be formed to communicate with the water collection chamber 127 through the discharge hole 129*c* at one side of the front part of the water collection chamber 127.

The bottom surface of the water collection chamber 127 may be provided with the first discharge surface 127*a* and the second discharge surface 127*b*. In this case, the first discharge surface 127*a* may be located at an upper side with respect to the discharge direction of the water collection chamber 127, and may be inclined at a predetermined angle so that the first discharge surface 127*a* is inclined downward toward the discharge hole 129*c*. The second discharge surface 128*b* may be located at a lower side with respect to the discharge direction of the water collection chamber 127, and may be inclined at a predetermined angle so that the second discharge surface 128*b* is inclined at a predetermined angle toward the discharge hole 129*c*.

In this case, the third discharge surface 127*c* may be located higher than the first and second discharge surfaces 127*a* and 127*b* at one side opposite to the discharge hole 129*c* with respect to the discharge direction of the water collection chamber 127, and may be inclined toward the discharge hole 129*c* at an angle different from those of the first and second discharge surfaces 127*a* and 127*b*.

On the other hand, each of the first, second, and third discharge surfaces 127*a*, 127*b*, and 127*c* may be configured in a manner that at least one of a forward and backward direction and a left and right direction of the water collection chamber 127 is inclined downward toward the discharge hole 129*c* with respect to the uppermost position of the water collection chamber 127.

The first discharge surface 127*a* of the water collection chamber 127 may be located at the uppermost side of the water collection chamber 127, and may be provided with the discharge hole 129*c*. The first discharge surface 127*a* may be inclined at a first angle D1 in a discharge direction of the water collection chamber 127, and at the same time may be inclined at a second angle D3 in the direction perpendicular to the discharge direction of the water collection chamber 127.

In addition, the highest point of the first discharge surface 127*a* may be located higher than the lowest point (i.e., the bottom surface of a position where the discharge hole 129*c* is formed) of the water collection chamber 127 by at least 10 mm, so that water introduced into the water collection chamber 127 can more smoothly flow into the water collection chamber 127.

On the other hand, the movement direction of water in the first discharge surface 127*a* may be inclined toward the discharge hole 129*a*. In more detail, as the first discharge surface 127*a* is formed inclined at the first angle D1 or the second angle D2, the water received from the front surface of the first discharge surface 127*a* obliquely moves toward the discharge hole 129*c*.

In this case, the first angle D1 of the first discharge surface 127*a* may be set to an angle of 2° to 4°. Preferably, the first angle D1 may be set to an angle of 3°.

In this case, the second angle D2 may be set to an angle of 0.5° to 2.5°. Preferably, the second angle D2 may be set to an angle of 1.5°.

The second discharge surface 127*b* of the water collection chamber 127 may be located below the first discharge surface 127*a* with respect to the discharge direction of the water collection chamber 127. The second discharge surface 127*b* of the water collection chamber 127 may be inclined at the third angle D3 toward the discharge hole 129*c* in the direction perpendicular to the discharge direction of the water collection chamber 127.

In this case, the second discharge surface 127 may be formed parallel to the discharge direction of the water collection chamber 127, and the third angle D3 may be set to an angle of 0.5° to 2.5° in the same manner as the second angle D2. Preferably, the second angle D3 may be set to an angle of 1.5°.

Meanwhile, the movement direction of the water flowing into the water collection chamber 127 may be inclined toward the discharge hole 129*c* according to the slopes of the first discharge surface 127*a* and the second discharge surface 127*b*.

In this case, the water moving along the first discharge surface 127*a* may move in the discharge direction of the water collection chamber 127 along the slope of the first angle D1 of the first discharge surface 127*a*, and at the same time may move obliquely toward the discharge hole 129*c* along the slope of the second angle D2.

That is, water in the first discharge surface 127*a* may move diagonally toward the discharge hole 129*c* along the slopes of the first angle D1 and the second angle D2.

Water moving from the first discharge surface 127*a* to the second discharge surface 127*b* may move perpendicular to the discharge direction of the water collection chamber 127 along the slope of the third angle D3 of the second discharge surface 127*b* using kinetic energy of the water flowing from the first discharge surface 127*a*.

On the other hand, the third discharge surface 127*c* may be formed to protrude from the height of at least the second discharge surface 127*b* in the direction opposite to the discharge hole 129*c* of the water collection chamber 127, and may have a slope formed parallel to the movement direction of the water flowing from the first discharge surface 127*a* to the second discharge surface 127*b*.

In other words, the third discharge surface 127*c* may be formed to protrude from at least the second discharge surface 127*b* in a manner that the edge of the water collection chamber 127 arranged to face the discharge hole 129*c* is formed in a right-angled triangle shape in which the edge of the water collection chamber 127 is at a right angle.

The second discharge surface 127*b* may be formed inclined in a manner that the water moving along the first discharge surface 127*a* and the second discharge surface 127*b* can flow into the discharge hole 129*c*, and at the same time may be curved in a concave shape.

The third discharge surface 127*c* may be formed inclined at a fourth angle D4 in the direction from the edge of the water collection chamber 127 facing the discharge hole 129*c* to the first discharge surface 127*a*, and at the same time may be formed inclined toward the discharge hole 129*c* by a fifth angle D5.

In other words, in association with the third discharge surface 127*c*, the edge side arranged to face the discharge hole 129*c* of the water collection chamber 127 may refer to the uppermost side, the edge side may be inclined toward the first discharge surface 127*a* while simultaneously being inclined toward the discharge hole 129*c*. Therefore, the water introduced into the third discharge surface 127*c* may flow into the first or second discharge surface 127*a* or 127*b* along the slopes of the fourth and fifth angles D4 and D5 of the third discharge surface 127*c*, and may then be discharged outside.

In this case, the fourth angle D4 of the third discharge surface 127*c* may be set to an angle of 1° to 3°. Preferably, the fourth angle D4 may be set to an angle of 1.9°.

In this case, the fifth angle D5 may be set to an angle of 1° or less. Preferably, the fifth angle D5 may be set to an angle of 0.7°.

The slope relationship among the first, second, and third discharge surfaces 127*a*, 127*b*, and 127*c* will hereinafter be described with reference to the attached drawings.

Figure 5:
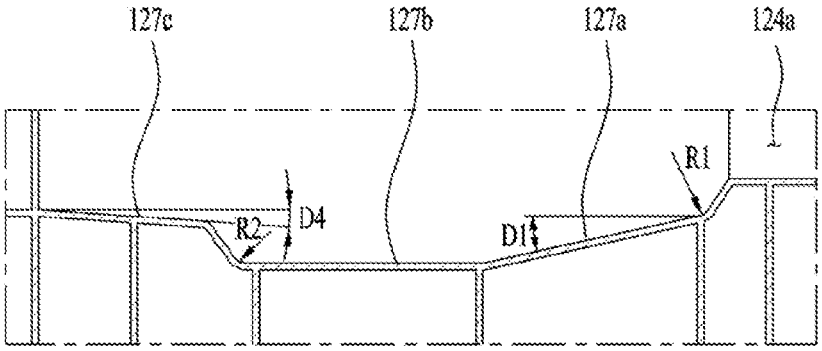
FIG. 5 is a partial cross-sectional view illustrating the laundry treatment apparatus taken along the line A-A' shown in FIG. 4 according to the present disclosure.
Figure 6:
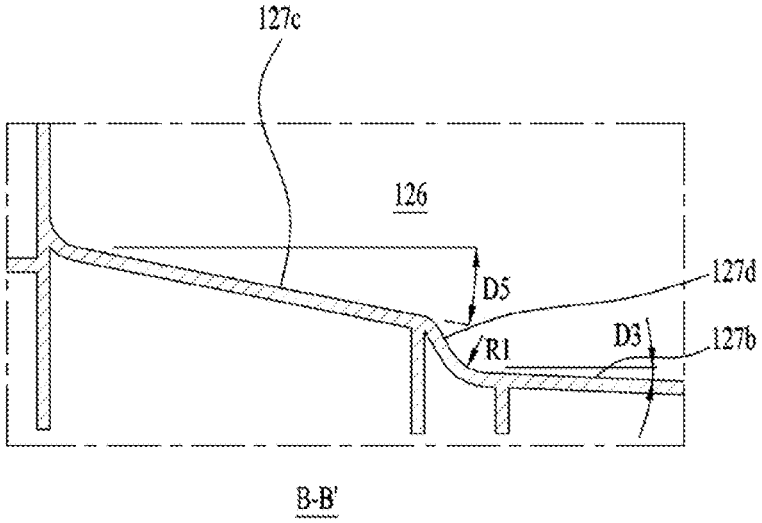
FIG. 6 is a partial cross-sectional view illustrating the laundry treatment apparatus taken along the line B-B' shown in FIG. 4 according to the present disclosure.

FIG. 5 is a partial cross-sectional view illustrating the laundry treatment apparatus taken along the line A-A' shown in FIG. 4 according to the present disclosure. FIG. 6 is a partial cross-sectional view illustrating the laundry treatment apparatus taken along the line B-B' shown in FIG. 4 according to the present disclosure. FIG. 4 is a cross-sectional view illustrating the first, second, and third discharge surfaces 127*a*, 127*b*, and 127*c* of the water collection chamber 127 in the direction parallel to the discharge direction of the water collection chamber 127. FIG. 5 is a cross-sectional view illustrating the second and third discharge surfaces 127*a* and 127*b* of the water collection chamber 127 in the direction perpendicular to the discharge direction of the water collection chamber 127.

Referring to FIG. 5, the water introduced into the first discharge surface 127*a* may move toward the second discharge surface 127*b* by the first angle D1 of the first discharge surface 127*a*. The water introduced into the third discharge surface 127*c* may move toward the second discharge surface 127*b* by the fourth angle D4 of the third discharge surface 127*c*.

In this case, it is preferable that the uppermost end of the first discharge surface 127*a* and the switching passage 124*a* adjacent to the first discharge surface 127*a* be formed to have a predetermined height difference therebetween in a manner that the switching passage 124*a* is located higher than the uppermost end of the first discharge surface 127*a* by a predetermined height. That is, since there is a difference in height between the switching passage 124*a* and the first discharge surface 127*a*, the water introduced into the water collection chamber 127 can be prevented from overflowing into the switching passage 125*a*.

In addition, a boundary between the first discharge surface 127*a* and the switching passage 124*a* may be formed to have a first radius R1. Due to the first radius R1 formed at the boundary between the first discharge surface 127*a* and the switching passage 124*a*, foreign materials introduced into the water collection chamber 127 can be smoothly discharged outside, and at the same time the foreign materials such as lint can be prevented from remaining on the boundary between the first discharge surface 127*a* and the switching passage 124*a*.

In addition, a boundary between the second discharge surface 127*b* and the third discharge surface 127*c* may also be formed to have a second radius R2. Due to the second radius R2 formed at the boundary between the second discharge surface 127*b* and the third discharge surface 127*c*, foreign materials introduced into the second discharge surface 127*b* from the third discharge surface 127*c* can smoothly move, and at the same time the foreign materials such as lint can be prevented from remaining on the boundary between the second discharge surface 127*b* and the third discharge surface 127*c*.

Meanwhile, as shown in FIG. 6, the third discharge surface 127*c* may be formed inclined toward the second discharge surface 127*b* by the fifth angle D5, and the second discharge surface 127*b* may be formed inclined toward the discharge hole 129*c* by the third angle D3. That is, the third discharge surface 127*c* may be formed inclined toward the first discharge surface 127*a* by the fourth angle D4, and may be formed inclined toward the discharge hole 129*c* by the fifth angle D5.

Therefore, water falling into the third discharge surface 127*c* may be directed to either the first discharge surface 127*a* or the second discharge surface 127*b* along the slopes of the fourth and fifth angles D4 and D4 of the third discharge surface 127*c*, and may then move toward the discharge hole 129*c*.

Figure 7:
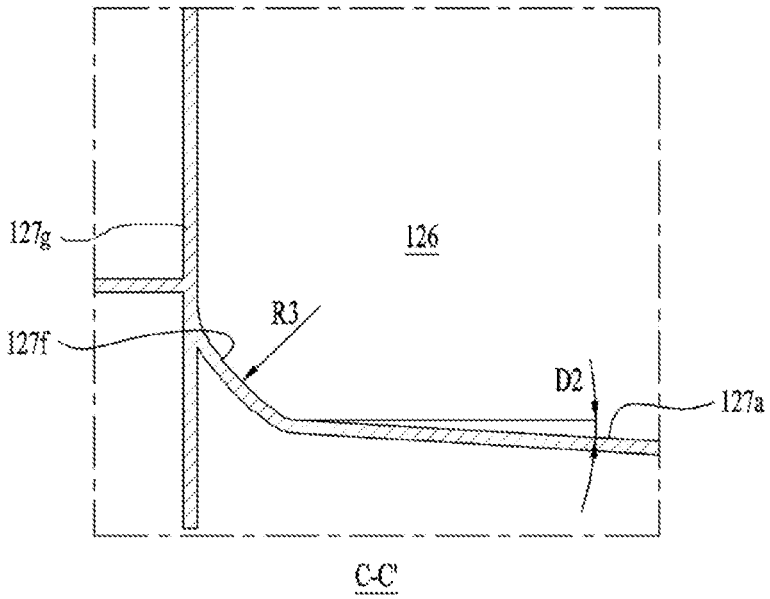
FIG. 7 is a partial cross-sectional view illustrating the laundry treatment apparatus taken along the line C-C' shown in FIG. 4 according to the present disclosure.

As shown in FIG. 7, an outer wall 127*g* forming a box shape of the water collection chamber 127 may be formed outside the first, second, and third discharge surfaces 127*a*, 127*b*, and 127*c*. The outer wall 127*g* may be fastened to the connection duct 35 so as to form a space in which not only the air passage, but also the heat absorption unit 41 and the heating unit 43 contained in the heat exchanger 4 are installed, and at the same time the water introduced into the water collection chamber 127 is prevented from overflowing to the outside of the water collection chamber 127.

The outer wall 127*g* may form the outer circumferential surface of the water collection chamber 127 formed by the first to third discharge surfaces 127*a*, 127*b*, and 127*c*. The first to third discharge surfaces 127*a*, 127*b*, and 127*c* and the outer wall 127*g* may be formed to have a third radius R3 having a predetermined curvature.

The third radius R3 formed at the outer wall 127*g* of the water collection chamber 127 may prevent foreign materials introduced into the water collection chamber 127 from remaining in the edge space between the outer wall 127*g* and the first to third discharge surfaces 127*a*, 127*b*, and 127*c* of the water collection chamber 127.

Figure 8:
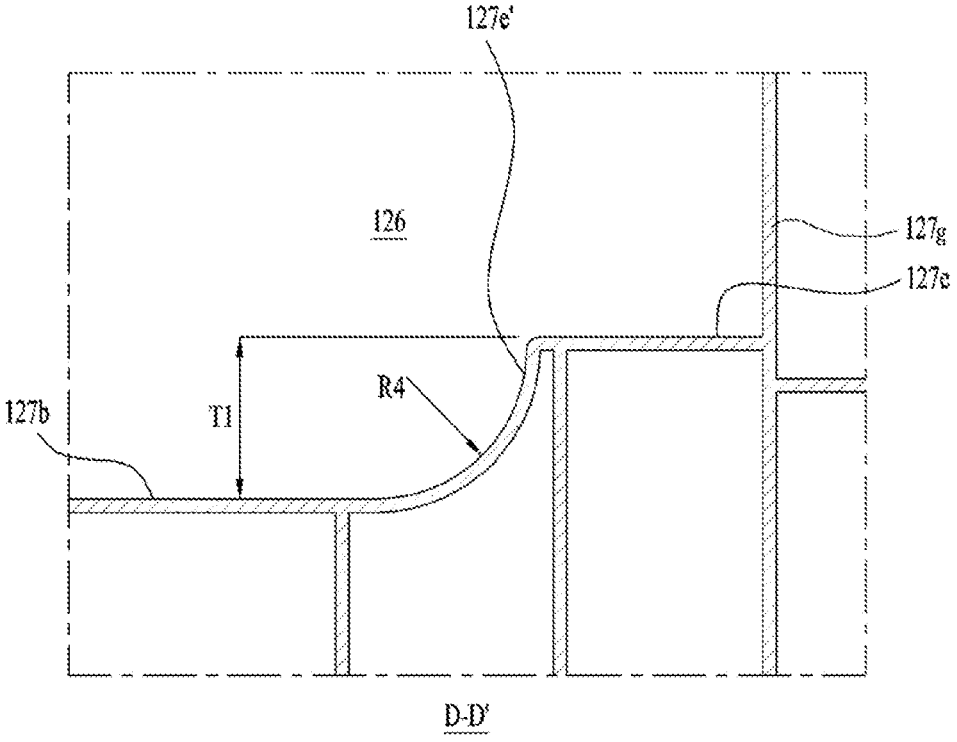
FIG. 8 is a partial cross-sectional view illustrating the laundry treatment apparatus taken along the line D-D' shown in FIG. 4 according to the present disclosure.

On the other hand, as shown in FIG. 8, a first stepped portion 127*e* located higher than the first or second discharge surface 127*a* or 127*b* so as to support the heat absorption unit 41 or the heating unit 43 installed in the water collection chamber 127 may be formed at one side opposite to the third discharge surface 127*c*.

Each of the first and second discharge surfaces 127*a* and 127*b* formed in the water collection chamber 127 may have an inclined surface, an angle of which is lower than that of the third discharge surface 127*c*, such that water introduced into the water collection chamber 127 can be directed to the discharge hole.

The heat absorption unit 41 and the heating unit 43 installed in the water collection chamber 127 should be installed in a horizontal state within the water collection chamber 127. Accordingly, from among the heat absorption unit 41 and the heating unit 43, the height of one side located opposite to the third discharge surface 127*c* should be increased based on the third discharge surface 127*c* formed at a position opposite to the discharge hole 129*c*.

Thus, the first stepped portion 127*e* for height adjustment about the third discharge surface 127*c* may protrude from one side (i.e., a side where the discharge hole 129*c* is formed) opposite to the third discharge surface 127*c* of the water collection chamber 127.

In this case, the first stepped portion 127*e* may be formed to protrude from the second discharge surface 127*b* by the height of the third discharge surface 127*c*, and may protrude from the second discharge surface 127*b* by the height T1. A fourth radius R4 having a predetermined curvature may be formed at the first stepped portion 127*e* and the edge of the second discharge surface 127*b* (or the first discharge surface 127*a*), thereby facilitating movement of water and foreign materials introduced into the water collection chamber 127.

Although not shown in the drawings, the first stepped portion 127*e* and the third discharge surface 127*c* may include plural support protrusions (not shown) that are formed to protrude to the same height so as to horizontally support the heat absorption unit 41 or the heating unit 43.

In other words, the first, second and third discharge surfaces 127*a*, 127*b*, and 127*c* of the water collection chamber 127 may be formed inclined at different slope angles. Therefore, the first stepped portions protruding to have the same height so as to support one side of the heat absorption unit 41 or the heating unit 43 may be disposed between the top surface of the first stepped portion 127*e* and the edge of the outer wall of the third discharge surface 127*c* in a manner that the heat absorption unit 41 or the heating unit 43 can be horizontally installed in the water collection chamber 127.

Figure 9:
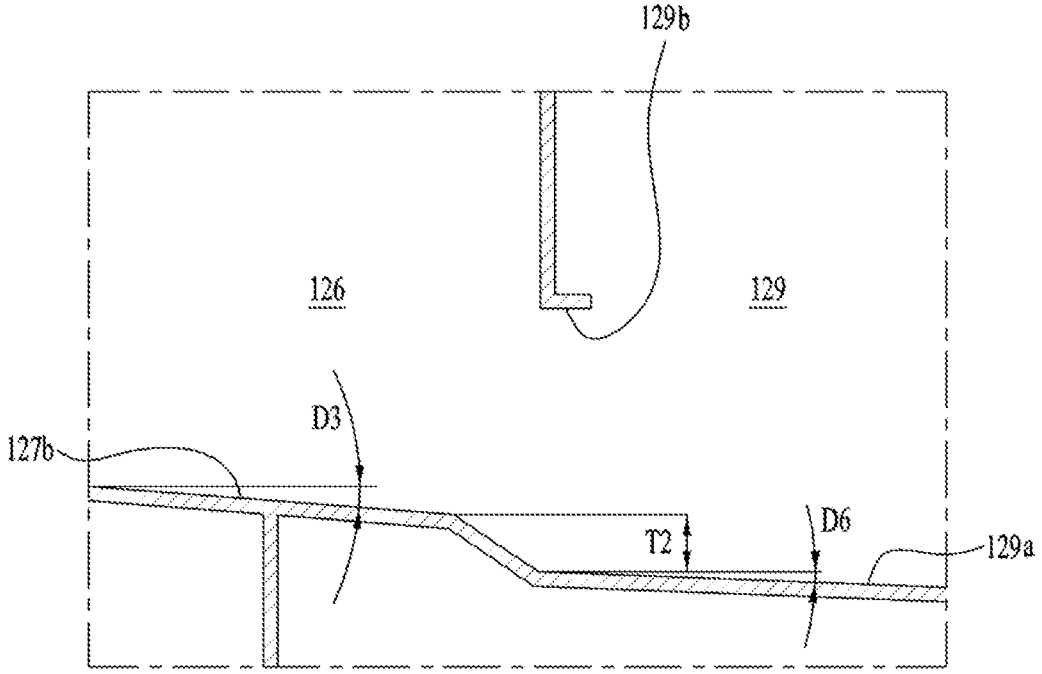
FIG. 9 is a partial cross-sectional view illustrating the laundry treatment apparatus taken along the line E-E' shown in FIG. 4 according to the present disclosure.

As shown in FIG. 9, water and foreign materials moving along the first, second, and third discharge surfaces 127*a*, 127*b*, 127*c* may be introduced into the pump discharge space 129*a* of the pump mounting unit 129 through the discharge hole 129*c*. Here, the bottom surface of the pump discharge space 129*a* may be provided with the pump discharge surface 129*b* that is located lower than the first, second, and third discharge surfaces 127*a*, 127*b*, and 127*c*.

The pump discharge surface 129*b* may be formed lower than the lowermost side of the second discharge surface 127*b* (formed to communicate with the discharge hole 129*c*) by a predetermined height T2, and may be formed inclined by a sixth angle D3 so that water and foreign materials from the first, second, and third discharge surfaces 127*a*, 127*b*, and 127*c* can be smoothly introduced into the pump discharge surface 129*b*.

As described above, the base 12 provided in the laundry treatment apparatus 100 according to the present disclosure can allow either water (condensate water) generated by the heat absorption unit 41 and the heating unit 43 contained in the water collection chamber 127 formed in the base 12 or water (wash water) sprayed to wash the heat absorption unit 41 to smoothly flow into the discharge hole 129*c* through the first, second, and third discharge surfaces 127*a*, 127*b*, and 127*c* of the water collection chamber.

That is, in a situation where water falls into the water collection chamber 127 of the base 12, although foreign materials are introduced into the water collection chamber 127 along with the water along slope angles of the first, second, and third discharge surfaces 127*a*, 127*b*, and 127*c*, the laundry treatment apparatus according to the present disclosure can prevent the foreign materials from remaining on the bottom surface of the water collection chamber 127, so that the foreign materials can be smoothly discharged along with the water.

As is apparent from the above description, the laundry treatment apparatus according to the embodiments of the present disclosure can improve a structure of a discharge passage along which wash water and foreign materials such as lint separated from the heat exchanger are moved when washing the heat exchanger, thereby smoothly discharging foreign materials and wash water.

In addition, the laundry treatment apparatus according to the embodiments of the present disclosure can improve the structure of a discharge passage to reduce a dead zone through which wash water having washed the heat exchanger does not pass, thereby smoothly discharging the wash water.

The laundry treatment apparatus according to the embodiments of the present disclosure can improve the structure of a discharge passage through which condensate water generated by the heat exchanger is discharged, so that the condensate water can be smoothly discharged outside.

It will be apparent to those skilled in the art that various modifications and variations can be made in the present disclosure without departing from the spirit or scope of the inventions. Thus, it is intended that the present disclosure covers the modifications and variations of this invention provided they come within the scope of the appended claims and their equivalents.

What is claimed is:

1. A laundry treatment apparatus comprising:

a cabinet that defines an external appearance of the laundry treatment apparatus, the cabinet having a base;

a drum rotatably located in the cabinet;

a driver configured to rotate the drum;

a duct that is disposed at the base and defines a circulation passage configured to communicate with the drum;

a heat pump comprising a heat exchanger that is located in the duct and configured to heat air;

a discharge unit configured to discharge water condensed by the heat exchanger; and a water pump disposed at the base and configured to provide the water condensed by the heat exchanger to the discharge unit, wherein the base includes:

a pump mounting unit that is defined at the base and disposed outside the duct, the water pump being disposed at the pump mounting unit, a water collection chamber that is defined at a bottom of the duct and configured to collect the water condensed by the heat exchanger, and a discharge hole that passes through a first side of the duct and fluidly connects the water collection chamber with the pump mounting unit, and wherein the water collection chamber comprises:

a first discharge surface that extends in a direction of the circulation passage and is configured to guide the water toward the discharge hole, and an additional discharge surface that protrudes upward relative to the bottom of the duct and is disposed higher than the first discharge surface, the additional discharge surface being configured to guide the water guided along the first discharge surface toward the discharge hole.

2. The laundry treatment apparatus according to claim 1, wherein the water collection chamber further comprises a second discharge surface that extends from the first discharge surface and inclined toward the discharge hole, wherein the first discharge surface is inclined downward toward the discharge hole by a first inclined angle, and wherein the second discharge surface is inclined downward toward the discharge hole by a second inclined angle different from the first inclined angle.

3. The laundry treatment apparatus according to claim 2, wherein the first inclined angle of the first discharge surface comprises:

a first angle inclined downward with respect to a first horizontal direction toward the second discharge surface; and a second angle inclined with respect to a second horizontal direction toward the discharge hole.

4. The laundry treatment apparatus according to claim 3, wherein the first angle is in a range from 2° to 4° with respect to the first horizontal direction toward the second discharge surface.

5. The laundry treatment apparatus according to claim 3, wherein the second angle is in a range from 0.5° to 2.5° with respect to the second horizontal direction toward the discharge hole.

6. The laundry treatment apparatus according to claim 2, wherein the second discharge surface extends parallel to a direction from the first discharge surface to the second discharge surface, and wherein the second discharge surface defines a third angle that is inclined with respect to a horizontal direction toward the discharge hole.

7. The laundry treatment apparatus according to claim 6, wherein the third angle is in a range from 0.5° to 2.5° inclined downward with respect to the horizontal direction toward the discharge hole.

8. The laundry treatment apparatus according to claim 1, wherein the additional discharge surface comprises a protruding surface that extends in a curve from a second side of the duct toward the discharge hole.

9. The laundry treatment apparatus according to claim 8, wherein the water collection chamber further comprises a second discharge surface that extends from the first discharge surface toward the discharge hole, and wherein the additional discharge surface extends from the second discharge surface and has a right-angled triangle shape, and an edge portion of the water collection chamber has a right angle and faces the discharge hole.

10. The laundry treatment apparatus according to claim 9, wherein the additional discharge surface defines a fourth angle inclined downward with respect to a horizontal direction toward the first discharge surface.

11. The laundry treatment apparatus according to claim 10, wherein the fourth angle is in a range from 1° to 3° inclined downward toward the first discharge surface.

12. The laundry treatment apparatus according to claim 9, wherein the additional discharge surface further defines a fifth angle inclined downward with respect to a horizontal direction toward the discharge hole.

13. The laundry treatment apparatus according to claim 12, wherein the fifth angle is less than or equal to 1°.

14. The laundry treatment apparatus according to claim 9, wherein the additional discharge surface is curved in a concave shape, the additional discharge surface having one side that faces a right-angled edge of the water collection chamber and that is inclined toward the discharge hole.

15. The laundry treatment apparatus according to claim 9, wherein the second discharge surface faces the additional discharge surface, and the second discharge surface further includes a stepped portion configured to support the heat exchanger.

16. The laundry treatment apparatus according to claim 15, wherein a height of the stepped portion is equal to a height of the additional discharge surface.

17. The laundry treatment apparatus according to claim 16, wherein the base further comprises a plurality of support protrusions that are disposed at the stepped portion and an upper portion of the additional discharge surface, the plurality of support protrusions being configured to support a lower portion of the heat exchanger.

18. The laundry treatment apparatus according to claim 17, wherein the stepped portion and the second discharge surface are connected to each other and define a concave shape having a radius of curvature between the stepped portion and the second discharge surface.

19. The laundry treatment apparatus according to claim 9, wherein the second discharge surface and the additional discharge surface are connected to each other and define a concave shape having a radius of curvature between the second discharge surface and the additional discharge surface.

20. The laundry treatment apparatus according to claim 1, further comprising:

a washing unit disposed in the circulation passage and configured to wash the heat exchanger by spraying water onto the heat exchanger.

21. The laundry treatment apparatus according to claim 20, wherein the discharge unit comprises a pump configured to pump water from the water collection chamber toward the discharge unit, the pump being configured to supply the water to the washing unit.

22. The laundry treatment apparatus according to claim 21, wherein the discharge unit comprises a pump discharge surface located vertically lower than the at least one of the first discharge surface or the additional discharge surface of the water collection chamber.

23. The laundry treatment apparatus according to claim 1, wherein the water collection chamber comprises an outer wall that defines a water collection space, and wherein the outer wall and the additional discharge surface are connected to each other and define a concave shape having a radius of curvature between the outer wall and the additional discharge surface.

24. The laundry treatment apparatus according to claim 1, wherein the additional discharge surface comprises a protruding surface relative to the bottom of the duct, and wherein at least a part of the protruding surface faces the discharge hole.

25. The laundry treatment apparatus according to claim 24, wherein the protruding surface extends from a second side of the duct to the first side of the duct toward the discharge hole.

* * * * *